United States Patent [19]

Priesman

[11] 4,010,696

[45] Mar. 8, 1977

[54] AUTOMOBILE TRAY

[75] Inventor: Herman William Priesman, Glendale, Calif.

[73] Assignee: The Raymond Lee Organization, New York, N.Y. ; a part interest

[22] Filed: Sept. 24, 1975

[21] Appl. No.: 616,278

[52] U.S. Cl. ..... 108/19; 108/44; 108/129; 108/132; 224/29 R; 224/42.11

[51] Int. Cl.[2] ..... A47B 85/00

[58] Field of Search ..... 108/18, 19, 44, 129, 108/132; 224/29 R, 42.11; 248/439

[56] References Cited

UNITED STATES PATENTS 3,048,457 8/1962 Haase ..... 108/44

3,880,091 4/1975 Heinonen ..... 108/44

*Primary Examiner*—James C. Mitchell

*Attorney, Agent, or Firm*—Howard I. Podell

[57] ABSTRACT

A tray for use in an automobile which is fitted on its underside with folding legs, of a size when extended to mount the tray on the floor inside a vehicle over the hump of the transmission shaft. The legs are each fitted with a projecting bracket which supports the ends of the tray in the extended position of the legs, with said brackets shaped to fit about the hump of a transmission shaft when the legs are folded so that the tray may rest directly on the said hump.

2 Claims, 3 Drawing Figures

AUTOMOBILE TRAY

SUMMARY OF THE INVENTION

My invention is a tray for use in an automobile which is fitted on its underside with folding legs, of a size when extended to mount the tray on the floor inside a vehicle over the hump of the transmission shaft. The legs are each fitted with a projecting bracket which supports the ends of the tray in the extended position of the legs, with said brackets shaped to fit about the hump of a transmission shaft when the legs are folded so that the tray may rest directly on the said hump.

The folding brackets are shaped so as to serve as short legs when the legs to which they are attached are folded, with the said brackets resting against a flat floor, or on a curve hump on the floor.

Each pair of legs may be joined together to form a C-shaped member, with the mid-portion of the C-shaped member rotatably fastened to the underside of the tray along a line parallel to the general plane of the tray bottom.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
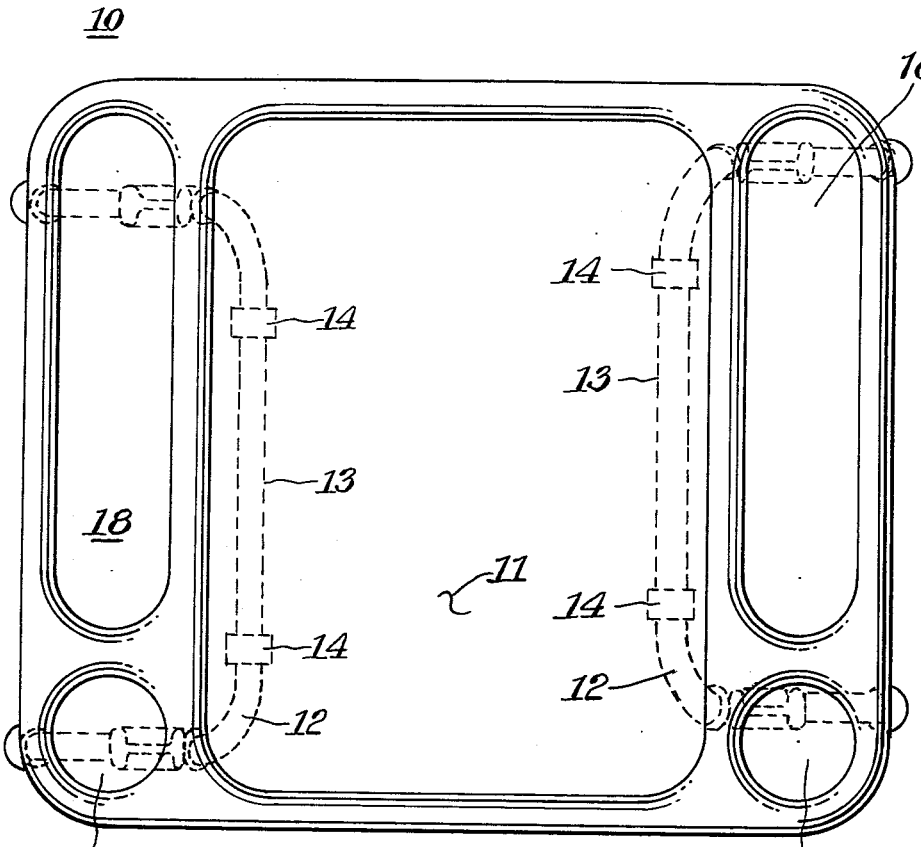
FIG. 1 is a plan view of the tray.
Figure 2:
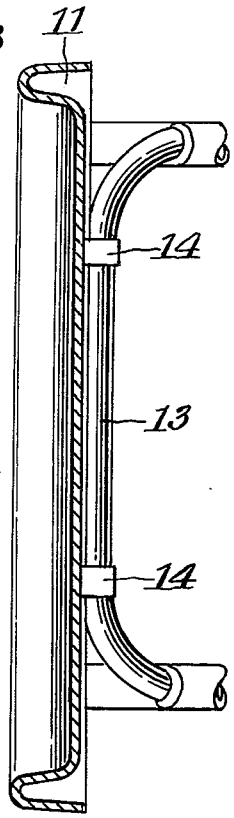
FIG. 2 is an end view of the tray.
Figure 3:
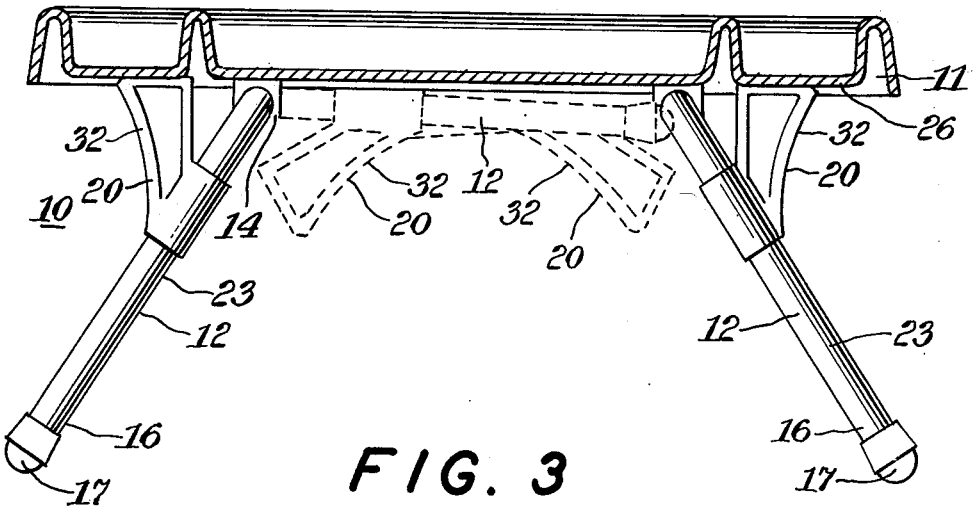
FIG. 3 is an elevation view of the tray.

Turning now descriptively to the drawings, in which similar reference characters denote similar elements throughout the several views, FIGS. 1–3 illustrate the tray assembly 10 comprising a molded tray 11 rotatably mounted on its underside to a pair of C-shaped leg members 12. Each leg member 12 is rotatably fastened along its mid-section 13 to a pair of bearing members 14 fitted to the underside of tray 11, with both free ends 16 of each leg member 12 capped by a plastic plug 17. A bracket 20 is mounted on each leg-section 23 of each leg member 12, with bracket 20 shaped to rest against the underside surface 26 of the tray 11 when the leg member is rotated in bearing members 14 to the fully extended position shown in solid lines in FIG. 3, so as to hold the attached leg member 12 from rotating towards the plane of the tray 11 when the tray assembly 10 rests on leg members 12 in the fully extended position. Leg sections 23 of each leg member 12 are of a length to permit the tray 11 to straddle over a hump on a vehicle floor of the type that houses the vehicle transmission.

Alternately each leg member 12 may be rotated in bearing members 14 to the retracted position shown in dash lines in FIG. 3, so that the leg sections 23 lie in a plane that is relatively parallel to the plane of the tray 11, with brackets 20 rotated free of engagement with the tray 11. In the retracted position, the brackets serve as short legs for the assembly with the lower sides 32 of the brackets, in the retracted position, shaped in concave fashion to rest on a curved hump surface, such as the hump surface of a transmission housing on a vehicle floor, or with the lower corner 34 of each bracket, in the retracted position, resting on a flat vehicle floor.

Tray 11 may be shaped with concave recesses 17 and 18 of a size and shape to anchor a glass or bottle.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A tray assembly adapted for mounting over a transmission hump in the floor of a vehicle comprising a shaped panel member that serves as a tray, pairs of bearing members fitted to the underside of said panel member, a plurality of pairs of legs, each pair of legs being interconnected by a mid-section to form a C-section, each of such C-sections being rotatably fastened to a pair of said bearing members, a bracket having a concave edge fastened to each leg of each C-section, said bracket shaped to engage the underside of said panel when the leg is rotated to a fully extended position, and located to hold the C-sections when fully extended in a plane which is at an obtuse angle to the plane of the tray, taken from a mid-section of the tray.

2. The combination as recited in claim 1 in which the concave edge of each bracket faces away from the panel in a retracted position of the attached leg whereby said concave edge may rest on said transmission hump.

* * * * *